US007217005B2

(12) United States Patent
Lin

(10) Patent No.: US 7,217,005 B2
(45) Date of Patent: May 15, 2007

(54) LIGHT EMITTING DIODE LAMP MODULE

(75) Inventor: Hung-Chih Lin, Taipei County (TW)

(73) Assignee: Grand Motomo Lights Co., Ltd., Taipei County (TW)

( * ) Notice: Subject to any disclaimer, the term of this patent is extended or adjusted under 35 U.S.C. 154(b) by 132 days.

(21) Appl. No.: 10/905,895

(22) Filed: Jan. 25, 2005

(65) Prior Publication Data

US 2006/0163598 A1 Jul. 27, 2006

(51) Int. Cl.
*F21V 21/00* (2006.01)

(52) U.S. Cl. ..... 362/249; 362/654; 362/800

(58) Field of Classification Search ..... 362/227, 362/235–237, 249, 653–654, 800, 806; 257/100
See application file for complete search history.

(56) References Cited

U.S. PATENT DOCUMENTS

| | | | | |
|---|---|---|---|---|
| 6,817,745 | B2 | 11/2004 | Leung et al. | 362/555 |
| 2004/0233668 | A1 | 11/2004 | Telfer et al. | 362/252 |
| 2005/0207176 | A1 | 9/2005 | Johnson et al. | 362/545 |
| 2005/0213321 | A1 | 9/2005 | Lin | 362/231 |

*Primary Examiner*—Sandra O'Shea
*Assistant Examiner*—Jason Moon Han
(74) *Attorney, Agent, or Firm*—J.C. Patents

(57) ABSTRACT

An LED lamps module is provided. The LED lamp module includes a plurality of LED lamps, a plurality of electric wires and a plurality of moisture-resisting members. In one embodiment of the present invention, each LED lamp includes a substrate with a circuit, at least one LED chip disposed on the substrate and connected with the circuitry electrically, a plurality of pins connected with the circuitry of the substrate electrically, and an encapsulant encapsulating the substrate, the LED chip and a portion of each pin. The electric wires are connected with the pins exposed. The moisture-resisting members encapsulat the pins exposed and a portion of each electric wire.

12 Claims, 5 Drawing Sheets

LIGHT EMITTING DIODE LAMP MODULE

BACKGROUND OF THE INVENTION

1. Field of the Invention

The invention relates to a light emitting diode (LED) lamp module, and more particularly to an light emitting diode lamp module with excellent moisture-resistance or water-resistance.

2. Description of the Related Art

LED lamps are widely used for automobiles, decorations and illumination products. Since LED lamps have superior electrical and mechanical characteristics, demands for LED lamps have been increased. In connection to this, interests in full-colored LED lamps are increasing as an alternative to fluorescent lamps and incandescent lamps.

Recently, buildings or plants in the city area are ornamented with some twinkling bulbs. Compared with the bulbs, LED lamp modules with twinkling function have longer lifetime, higher brightness and lower power consumption, therefore the bulbs are gradually substituted with the LED lamp modules. Since decorations having the LED lamps are generally hung on buildings or plants (e.g. trees) outdoor for ornamental purpose, the moisture-resistance of the LED lamp module is very important.

FIG. 1A is a perspective view showing a conventional LED lamp module; and FIG. 1B is a cross-sectional view showing a conventional LED lamp module. Referring to FIG. 1A, the conventional LED lamp module 100 includes LED lamps 110, sleeves 120, electric wires 130 and connectors 140. The relationships of the elements mentioned above are described in detail as follows.

Referring to FIG. 1A and FIG. 1B, each LED lamp 110 includes a carrier 112, a LED chip 114 disposed on the carrier 112, a bonding wires 116 electrically connected between the carrier 112 and the LED chip 114, and an encapsulant 118 that encapsulates a portion of the carrier 112, the LED chip 114 and the bonding wires 116. Specifically, the carrier 112 includes a first pin 112*a*, a second pin 112*b* and a pedestal portion 112*c* connected with one end of the first pin 112*a*. The LED chip 114 is disposed on the pedestal portion 112*c* and is electrically connected with the first pin 112*a* and the second pin 112*b* by the bonding wires 116. The LED chip 114, the pedestal portion 112*c*, a portion of the first pin 112*a* and a portion of the second pin 112*b* are encapsulated by the encapsulant 118.

Each LED lamp 110 is assembled with one sleeve 120. When assembling the LED lamp 110 with the sleeve 120, the LED lamp 110 is plugged into the sleeve 120 such that the first pin 112*a* and the second pin 112*b* of the LED lamp 110 will be exposed ouside the sleeve 120. Then, the first pin 112*a* and the second pin 112*b* exposed are bent to lean against the outer surface of the sleeve 120.

Still referring to FIG. 1A and FIG. 1B, each connector 140 includes a housing 142 for accommodating the sleeve 120 and two conductive plates 144*a*, 144*b* disposed on the inner surface of the housing 142. The electric wires 130 are electrically connected with the conductive plates 144*a*, 144*b* of the connector 140 correspondingly. In addition, the LED lamps 110 assembled with the sleeves 120 is plugged into the connector 140, such that the conductive plates 144*a*, 144*b* are electrically connected with the first pin 112*a* and the second pin 112*b*, which are bent to lean against the outer surface of the sleeve 120. In other words, the electric wires 130 are electrically connected with the LED chips 114 through the conductive plates 144*a*, 144*b*, the first pin 112*a* and the second pin 112*b*.

In the LED lamp module 100 as described above, the conductive plates 144*a*, 144*b*, the first pin 112*a* and the second pin 112*b* are protected from moisture (or water) by the housings 142 of the connectors 140. It should be noted that a gap is formed between the sleeves 120 and the connectors 140 during assembling, such that moisture (or water) permeating from the gap with rust the conductive plates 144*a*, 144*b*, the first pin 112*a* and the second pin 112*b*. In the prior art, the LED lamp module 100 has little moisture-resistance or water-resistance, and the lifetime of the LED lamp module 100 is short.

SUMMARY OF THE INVENTION

The invention is directed to provide an LED lamps module with excellent moisture-resistance or water-resistance.

As embodied and broadly described herein, the present invention provides an LED lamps module. The LED lamp module includes a plurality of LED lamps, a plurality of electric wires and a plurality of moisture-resisting members. In one embodiment of the present invention, each LED lamp includes a substrate with a circuitry, at least one LED chip disposed on the substrate and connected with the circuitry electrically, a plurality of pins connected with the circuitry of the substrate electrically, and an encapsulant encapsulating the substrate, the LED chip and a portion of each pin. The electric wires are connected with the pins exposed. The moisture-resisting member encapsulats the pins exposed and a portion of each electric wire.

In an embodiment of the present invention, the LED lamp may be a full-colored LED lamp with two pins or four pins. The LED chip disposed in the full-colored LED lamp including a red LED chip, a green LED chip and a blue LED chip, for example.

In an embodiment of the present invention, the LED lamp module further includes a control integrated circuitry disposed on the surface (top surface or bottom surface) of the substrate, and the control integrated circuitry is encapsulated by one of the encapsulants. Moreover, the LED lamp module further includes an electrostatic protection circuitry integrated in each control integrated circuitry or in each circuitry of the substrate.

In an embodiment of the present invention, the LED lamp module further includes a plurality of ornaments, e.g. light-guiding members or light-reflecting members having any structure, for covering the LED lamps.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1A:
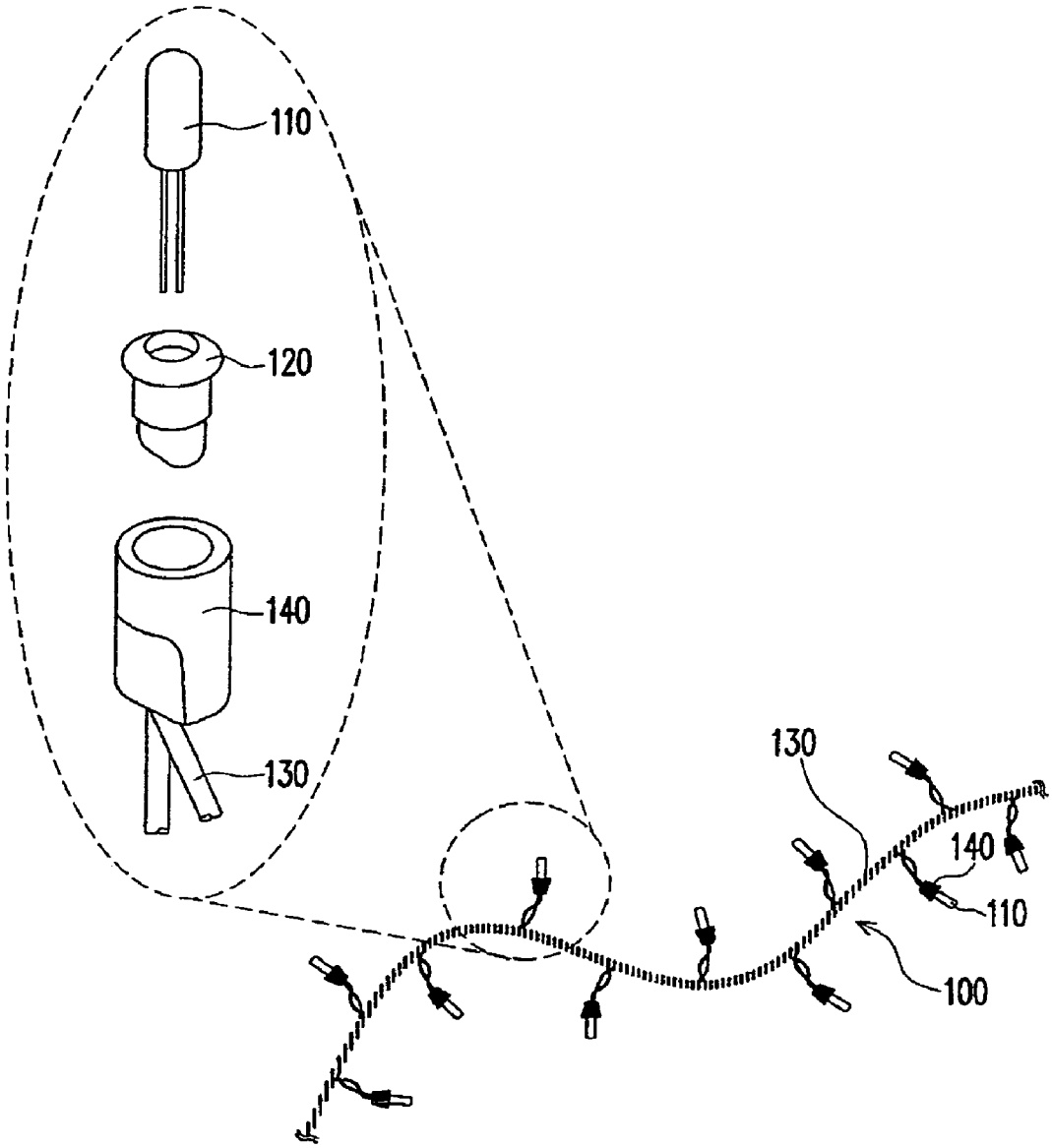
FIG. 1A(PRIOR ART)
FIG. 1A is a perspective view showing a conventional LED lamp module.
Figure 1B:
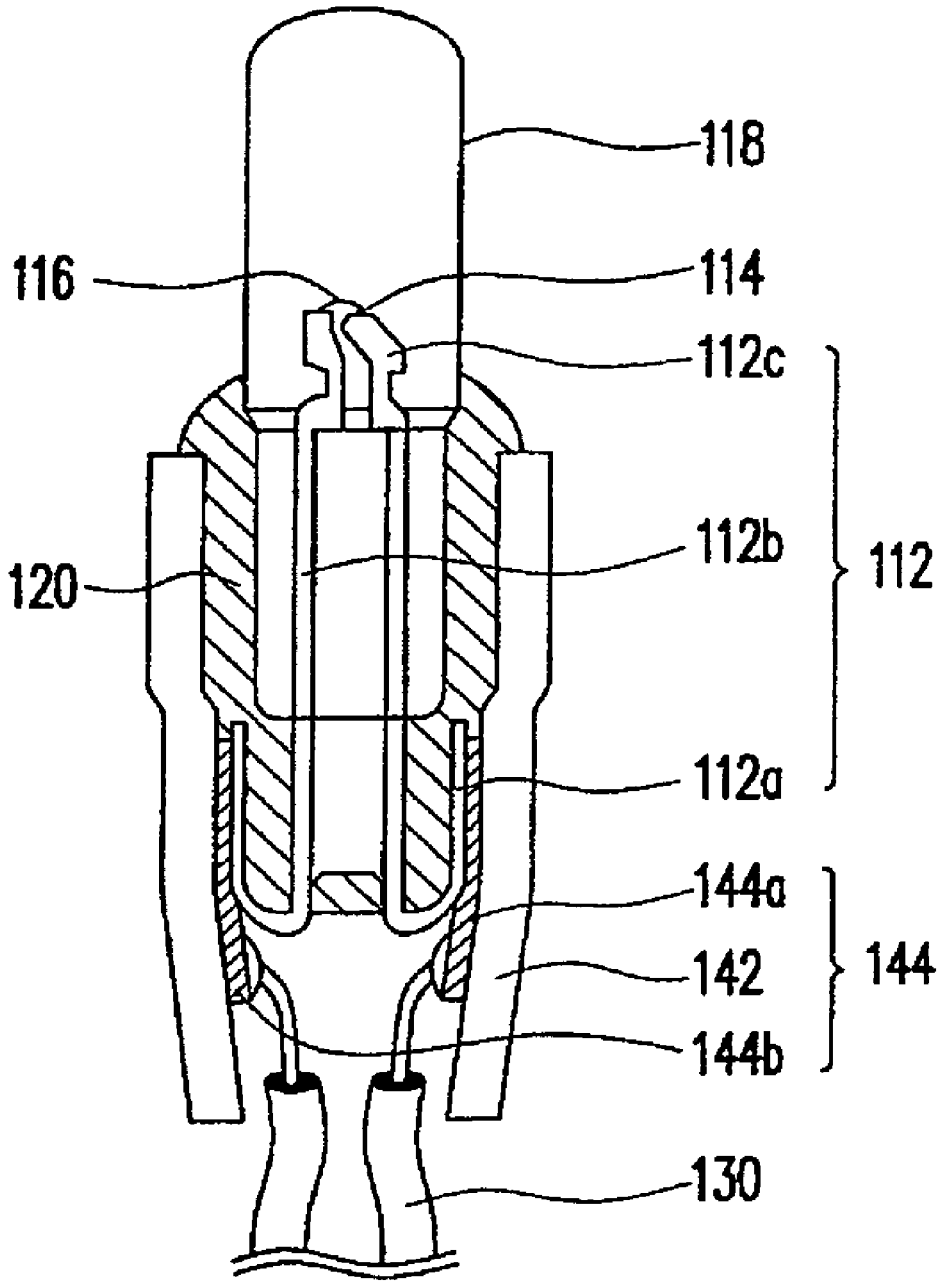
FIG. 1B(PRIOR ART)
FIG. 1B is a cross-sectional view showing a conventional LED lamp module.
Figure 2A:
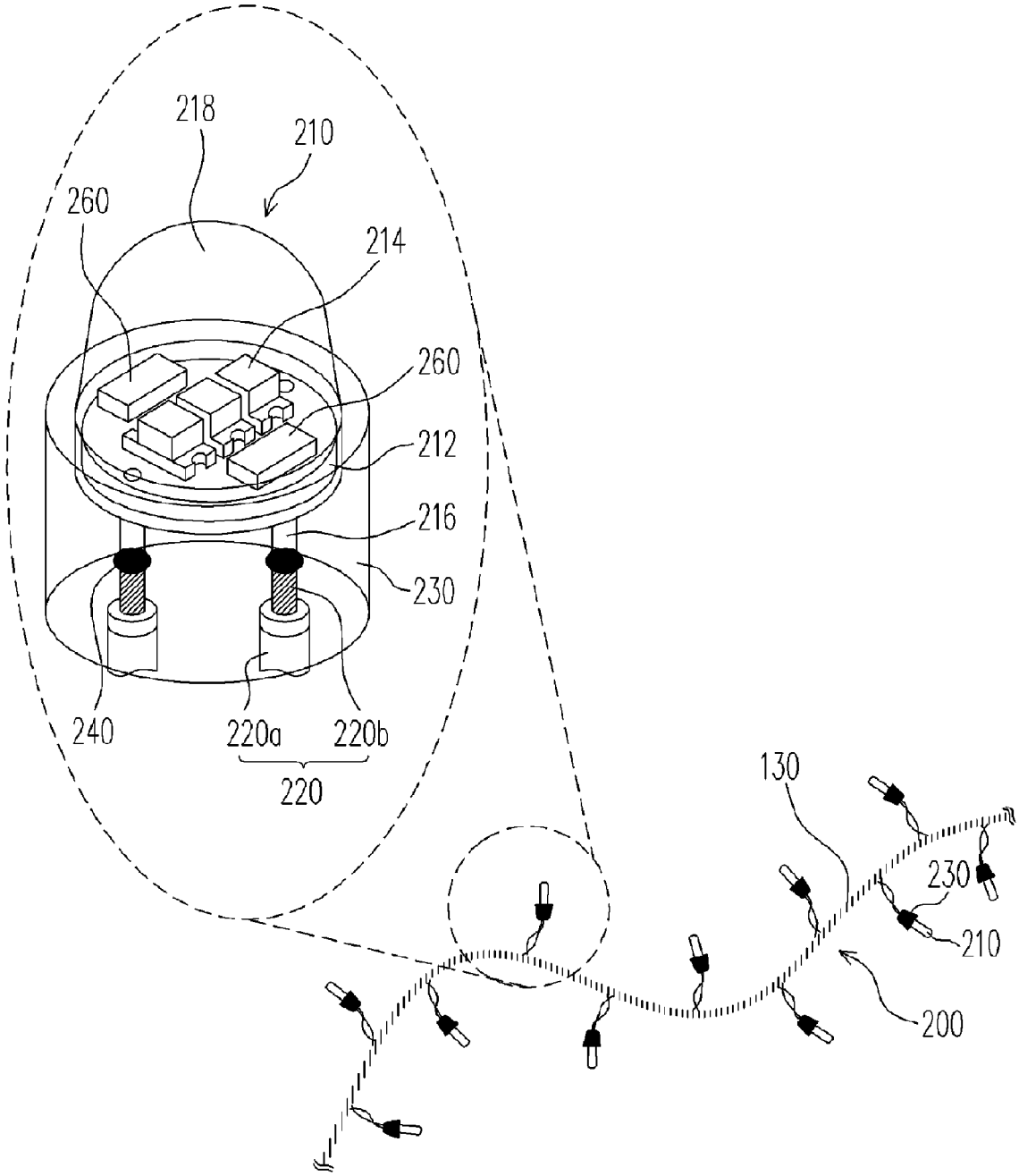
FIG. 2A is a perspective view showing an LED lamp module in accordance with the first embodiment of the present invention.

FIG. 2A is a perspective view showing an LED lamp module in accordance with the first embodiment of the present invention. Referring to FIG. 2A, the LED lamp module 200 of the present invention includes a plurality of LED lamps 210, a plurality of electric wires 220 and a plurality of moisture-resisting members 230. The relationship of the elements mentioned above is described in detail as follows.

Referring to FIG. 2A, each LED lamp 210 includes a substrate 212 with a circuitry, at least one LED chip 214 disposed on the substrate 212 and connected with the circuit electrically, a plurality of pins 216 connected with the circuit of the substrate 212 electrically, and an encapsulant 218 encapsulating the substrate 212, the LED chip 214 and a portion of each pin 216. The electric wires 220 are connected with the pins 216 that are exposed outside the encapsulant 218. The moisture-resisting members 230 encapsulats the pins 216 exposed outside the encapsulant 218 and a portion of each electric wire 220.

Figure 3:
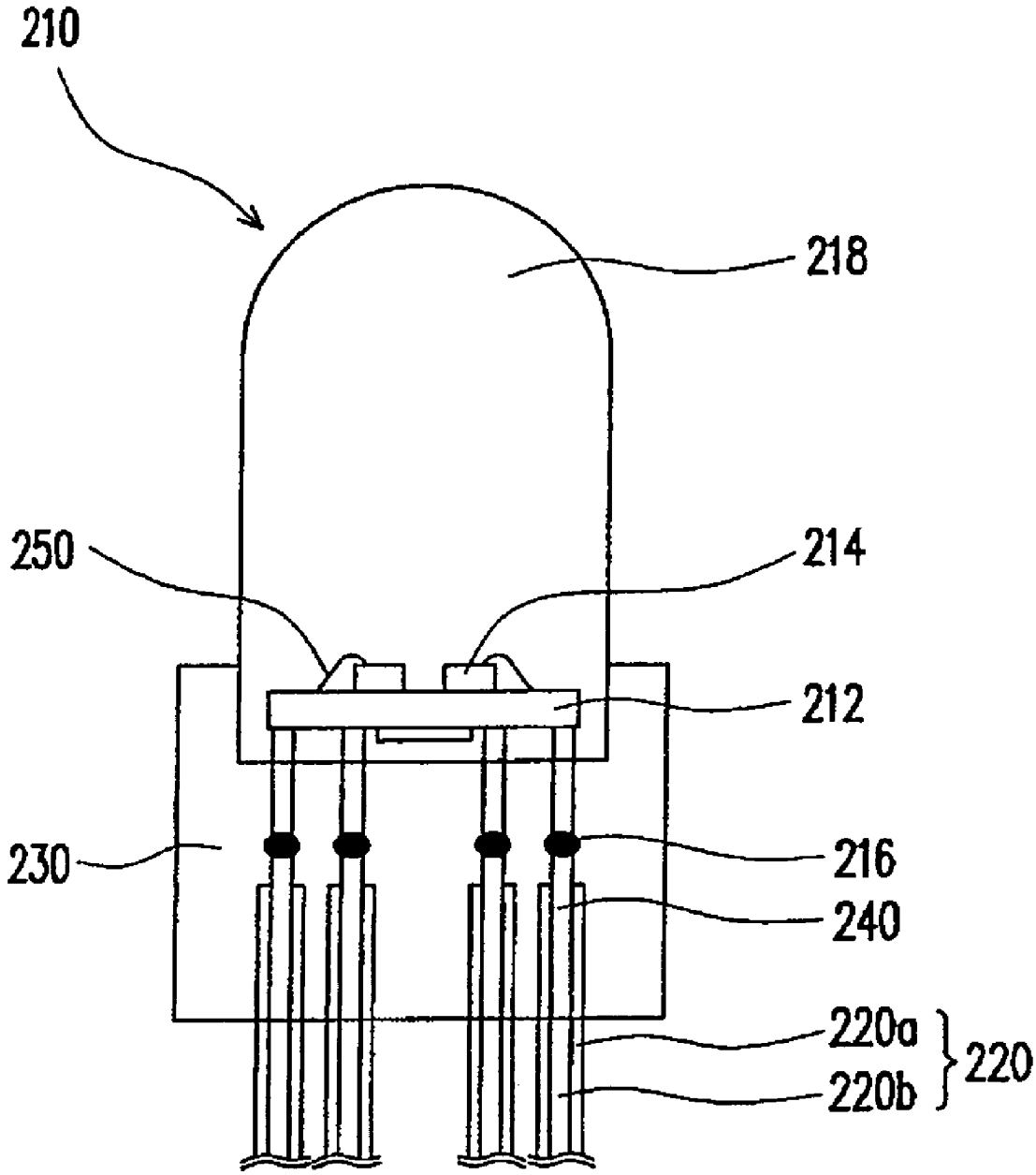
FIG. 3 illustrates an LED lamp has four pins in accordance with the first embodiment of the present invention.

In an embodiment of the present invention, the LED lamp 210 may be a full-colored LED lamp with two pins or four pins (as shown in FIG. 3). The number of the pins is not limited in the present invention. The LED chips 214 disposed in the full-colored LED lamp including a red LED chip, a green LED chip and a blue LED chip, as shown in FIG. 2A. However, the number and the type of the LED chips are not limited in the present invention. Specifically, several monochromatic LED chips with the same emission characteristics can also be used in the present invention.

Figure 2B:
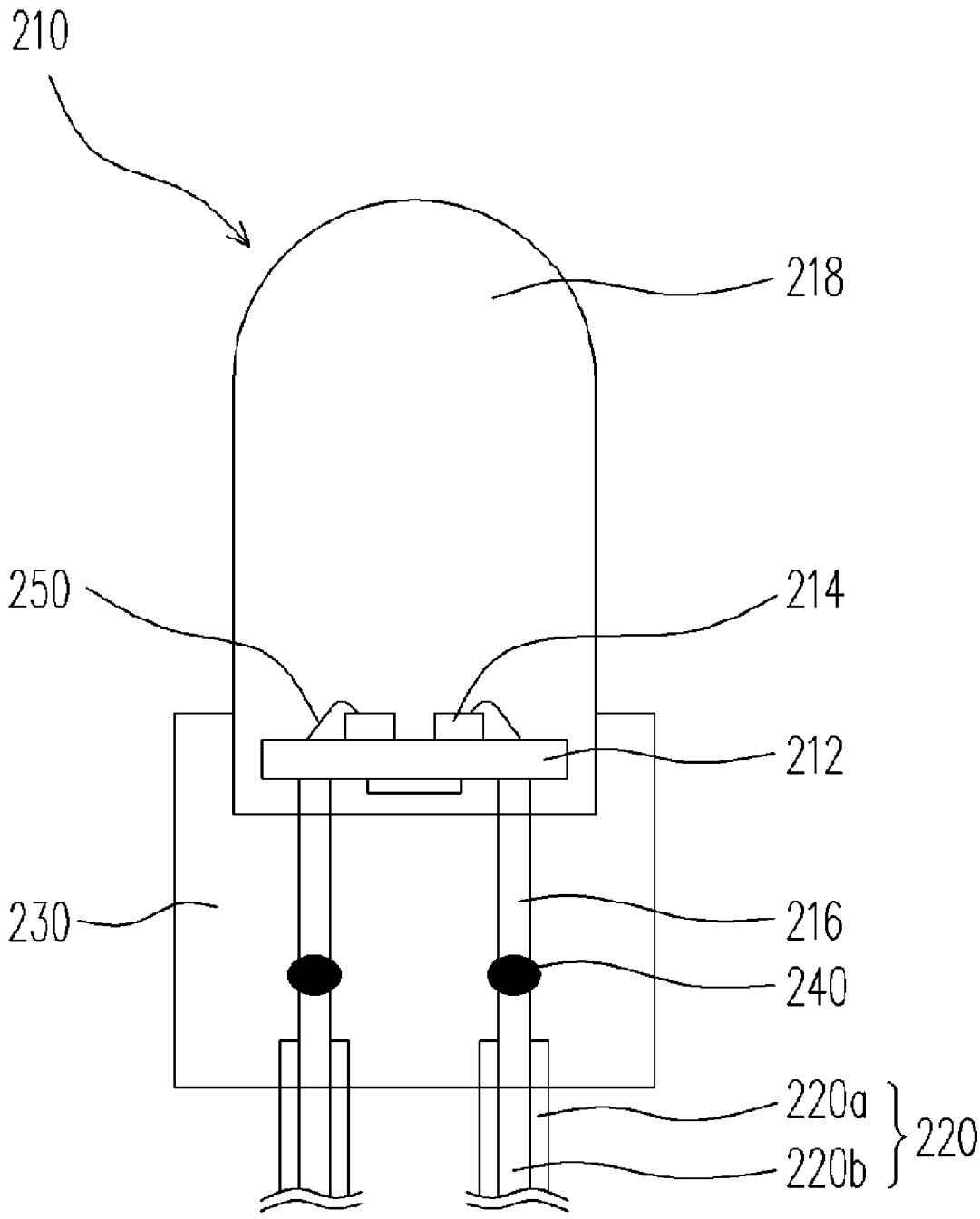
FIG. 2B is a cross-sectional view showing an LED lamp module in accordance with the first embodiment of the present invention.

FIG. 2B is a cross-sectional view showing an LED lamp module in accordance with the first embodiment of the present invention. Referring to FIG. 2A and FIG. 2B, in the present embodiment, the electric wire 220 includes an insulating layer 220*a* and a conductive wire 220*b* wrapped in the insulating layer 220*a*. As shown in FIG. 2A and FIG. 2B, one end of the conductive wire 220*b* are exposed by the insulating layer 220*a*, and the exposed end of the conductive wire 220*b* is connected with one of the pins 216 of the LED lamp 210 by solder material 240. However, the electric wires 220 and the pins 216 may also be connected by other possible techniques. For example, each pin 216 may have a piercing end to pierce through the insulating layer 220*a* and connect with the conductive wire 220*b*. As shown in FIG. 2A and FIG. 2B, in each LED lamp 210, not only are the pins 216 exposed outside the encapsulant 218, but also a portion of each electric wire 220, the bottom of the encapsulant and the solder material 240 are encapsulated by the moisture-resisting members 230.

Referring to FIG. 2B, in one embodiment of the present invention, each LED lamp 210 further includes a plurality of bonding wires 250 connected between the LED chips 214 and the circuitries electrically. However, the connection between the LED chips 214 and the substrate 212 is limited to wire bonding process. Any skilled artisan can use flip-chip bonding process, surface mount technologhy or other alternative bonding techniques.

In an embodiment of the present invention, each substrate 212 has a top surface and a bottom surface, the LED chips 214 are disposed on the top surface of the substrate 212, and the pins 216 are protruded from the bottom surface of the substrate 212. In addition, the LED lamp 210 may further includes a control integrated circuit (control IC) 260 disposed on the top surface (shown in FIG. 2A) or the bottom surface (shown in FIG. 2B) of the substrate 212. Each control IC 260 is encapsulated by the encapsulants 218.

It should be noted that an electrostatic protection circuit may be integrated in each control IC 260 or be integrated in the circuit of the substrate 212. The material of the moisture-resisting members 230 includes plastics or other materials with excellent moisture-resistance.

In order to obtain excellent moisture-resistance, the moisture-resisting members of the present invention are being substituted for the sleeve and the connector of the prior art. The moisture-resisting members tightly connected with bottom portion of the encapsulant 218 may be formed by injection molding process. The LED lamp module 200 with excellent moisture-resistance may be fabricated by the following process. First, LED lamps 210 each having pins 216 are provided. Then, the pins 216 of the LED lamps 210 and electric wires 220 are welded by solder material 240. However, the pins 216 of the LED lamps 210 and electric wires 220 are welded by other possible processes. Ultimately, the moisture-resisting members 230 are formed to encapsulate the pins 216 exposed outside the encapsulant 218, a portion of each electric wire 220 and the solder material 240.

When forming the moisture-resisting members 230 by injection molding processes, electrostatic damage, thermal deterioration or other problems of the LED lamps 210 may occur so as to damage the LED chips 214 of the LED lamps 210. Therefore, the control IC 260 or the circuit of the substrate 212 with electrostatic protection function can prevent the LED chips 214 from failing.

It should be noted that the LED lamp module 200 may further includes a plurality of ornaments for covering the LED lamps 210. In an embodiment of the present invention, the ornaments comprise light-guiding members or light-reflecting members with various structures.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A light emitting diode (LED) lamp module, comprising a plurality of LED lamps, wherein each LED lamp comprises:

a substrate with a circuit;

at least one LED chip disposed on the substrate and connected with the circuit electrically;

a plurality of pins connected with the circuit of the substrate electrically;

an encapsulant encapsulating the substrate, the LED chip and a portion of each pin;

a plurality of electric wires connected with the exposed portion of the pins not surrounded by the encapsulant; and a moisture-resisting member, encapsulating the bottom of the encapsulant, the exposed portion of the pins of the LED lamp and a portion of each of the plurality of electric wires.

2. An LED lamp module according to claim 1, wherein at least one LED lamp is a full-colored LED lamp.

3. An LED lamp module according to claim 1, wherein the LED chips, disposed on the substrate, comprise a red LED chip, a green LED chip and a blue LED chip.

4. An LED lamp module according to claim 1, wherein the LED lamp has two pins or four pins.

5. An LED lamp module according to claim 1, wherein each LED lamp further comprises a plurality of bonding wires connected between the LED chips and the circuit electrically.

6. An LED lamp module according to claim 1, wherein each substrate has a first surface and a second surface, wherein the LED chip is disposed on the first surface, and the pins are protruded from the second surface.

7. An LED lamp module according to claim 6, wherein each LED lamp further comprises a control integrated circuit disposed on the first surface or the second surface of the substrate, wherein each control integrated circuit is encapsulated by one of the encapsulants.

8. An LED lamp module according to claim 7, further comprising an electrostatic protection circuit integrated in each control integrated circuit.

9. An LED lamp module according to claim 1, further comprising an electrostatic protection circuit integrated in each circuit of the substrate.

10. An LED lamp module according to claim 1, further comprising a solder material, wherein the electric wires and the pins are welded together with the solder material, and the solder material is encapsulated by the moisture-resisting members.

11. An LED lamp module according to claim 1, wherein each electric wire comprises:

an insulating layer; and a conductive wire wrapped in the insulating layer, wherein an end of the conductive wire are exposed from the insulating layer, and the exposed end of the conductive wire is connected with one of the pins.

12. An LED lamp module according to claim 1, wherein the moisture-resisting members comprises plastics.

* * * * *